US006128887A

United States Patent [19]

Suokas et al.

[11] Patent Number: 6,128,887

[45] Date of Patent: Oct. 10, 2000

[54] METHOD FOR PACKAGING FLAT ARTICLES

[75] Inventors: Jouni Suokas, Tammela; Kari Heikkilä, Forssa, both of Finland

[73] Assignee: Jomet Oy, Forssa, Finland

[21] Appl. No.: 09/230,163

[22] PCT Filed: Sep. 18, 1997

[86] PCT No.: PCT/FI97/00557

§ 371 Date: Jan. 21, 1999

§ 102(e) Date: Jan. 21, 1999

[87] PCT Pub. No.: WO98/13263

PCT Pub. Date: Apr. 2, 1998

[30] Foreign Application Priority Data

Sep. 27, 1996 [FI] Finland ..... 963853

[51] Int. Cl.[7] ..... B65B 35/56; B65G 47/24

[52] U.S. Cl. ..... 53/446; 53/542; 53/544; 198/374

[58] Field of Search ..... 414/621, 788.3, 414/791.2–791.4; 271/185; 198/374; 53/446, 544, 542

[56] References Cited

U.S. PATENT DOCUMENTS

| | | | |
|---|---|---|---|
| 4,015,724 | 4/1977 | Spencer | 414/788.3 |
| 4,043,461 | 8/1977 | Castro | 198/374 |
| 4,155,133 | 5/1979 | Timson | 198/374 |
| 4,354,787 | 10/1982 | Gensike et al. | 414/791.2 |
| 4,384,813 | 5/1983 | Smith et al. | 198/374 |
| 4,616,821 | 10/1986 | Boeve et al. | 414/791.2 |
| 4,655,663 | 4/1987 | Rosati | 414/788.3 |
| 4,861,213 | 8/1989 | Fuchs | 271/185 |
| 5,002,456 | 3/1991 | Gosslinghoff | 414/788.3 |
| 5,417,037 | 5/1995 | Osti et al. | 53/446 |
| 5,447,013 | 9/1995 | Boriani et al. | 53/446 |

FOREIGN PATENT DOCUMENTS

| | | |
|---|---|---|
| 0 367 727 A2 | 5/1990 | European Pat. Off. . |
| 0 506 606 A1 | 2/1992 | European Pat. Off. . |

*Primary Examiner*—Paul N. Dickson
*Assistant Examiner*—Matthew Luby
*Attorney, Agent, or Firm*—Pollock, Vande Sande & Amernick, R.L.L.P.

[57] ABSTRACT

In a method for packaging flat articles, articles are brought in a continuous stack (P) along a support level to a grouping station so that their planes are upright from the support level, wherein product batches to be placed in a package, such as a box, are separated from the stack by an automatic grouping device. For grouping articles having different thicknesses at different ends in the direction of their plane, a stack portion (OP) is separated from the stack, the stack portion is gripped by a gripping device, and it is rotated around one axis so that its direction deviates from the original. The first stack portions (OP) so rotated are placed next to such second stack portions, whose directions in relation to said one axis deviate 180° from the direction of the first stack portions, and the first and second stack portion so placed next to each other are formed to the product batch to be placed in the package.

5 Claims, 5 Drawing Sheets

METHOD FOR PACKAGING FLAT ARTICLES

FIELD OF THE INVENTION

The invention relates to a method for packaging flat articles. The invention relates also to a packaging apparatus. This application is a 371 of PCT/F197/00557 filed Sep. 18, 1997.

BACKGROUND OF THE INVENTION

Upon packaging large series of flat articles. The articles are formed into stacks of suitable size which are moved into the package. In these stacks, the articles are parallel, and the goal is to place them tightly against each other in the direction transverse to their planes. A typical example of articles of this kind is envelopes. The handling and packaging of envelopes is described e.g. in the Finnish Patent No. 94042 and in the Finnish published specification No. 97355 by the applicant.

Some articles have such a structure that the thickness of the article is not constant in the direction of its plane. A good example of such a product is envelopes and bag covers which are filled in from the short end, at which there is a closing flap and possibly also a paper covering the adhesive area on it, whereby the product is clearly thicker at one end. If the closing flap is folded out, it forms the thinnest end of the article. When articles of this kind are packaged with an automatic packaging apparatus, in which the articles run in a continuous stack, such constructional features cause more thickness at one end of the stack, which may hamper space utilization.

SUMMARY OF THE INVENTION

The purpose of the invention is to present an improvement to the above-mentioned prior art. From the continuous stack entering the handling step, the product batch to be packaged is not separated and moved as such into the package, but stack portions smaller than the product batch are separated from it and placed next to each other so that the second stack portions come into a 180° rotated position in relation to the first ones, and the adjacent stack portions so handled constitute the product batch, in which the thicker ends point at opposite directions.

The apparatus comprises means for separating a stack portion from the continuous stack, a gripper which is suspended in a rotation axle and which effects a rotation of 180° of the stack portions in relation to each other, as well as a product batch forming device in the area of motion of the gripper for arranging the stack portions next to each other.

BRIEF DESCRIPTION OF THE DRAWINGS

In the following, the invention will be described in more detail with reference to the appended drawings, in which.

Figure 2:
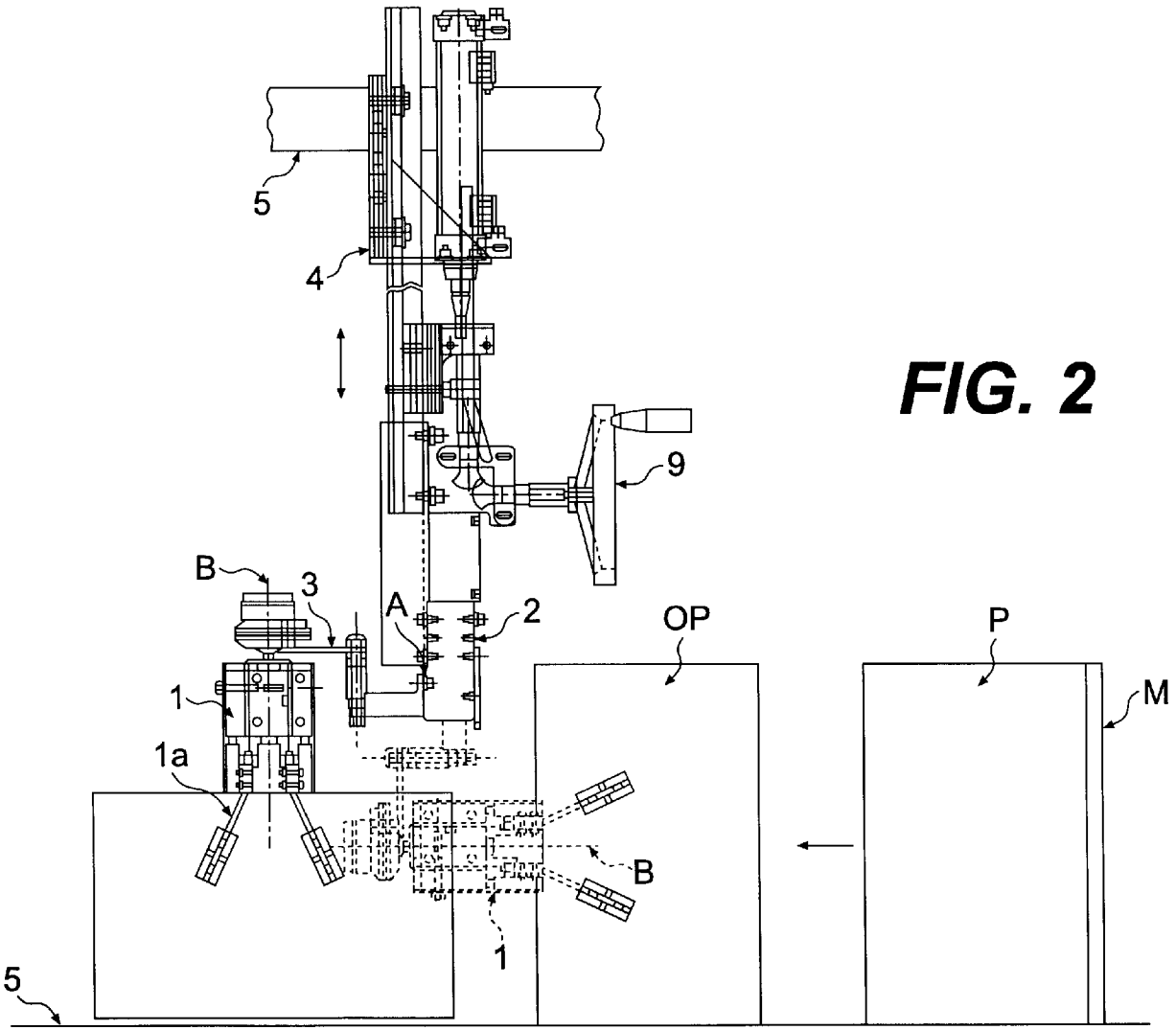
FIG. 2 shows the apparatus of the invention from the front.
Figure 3:
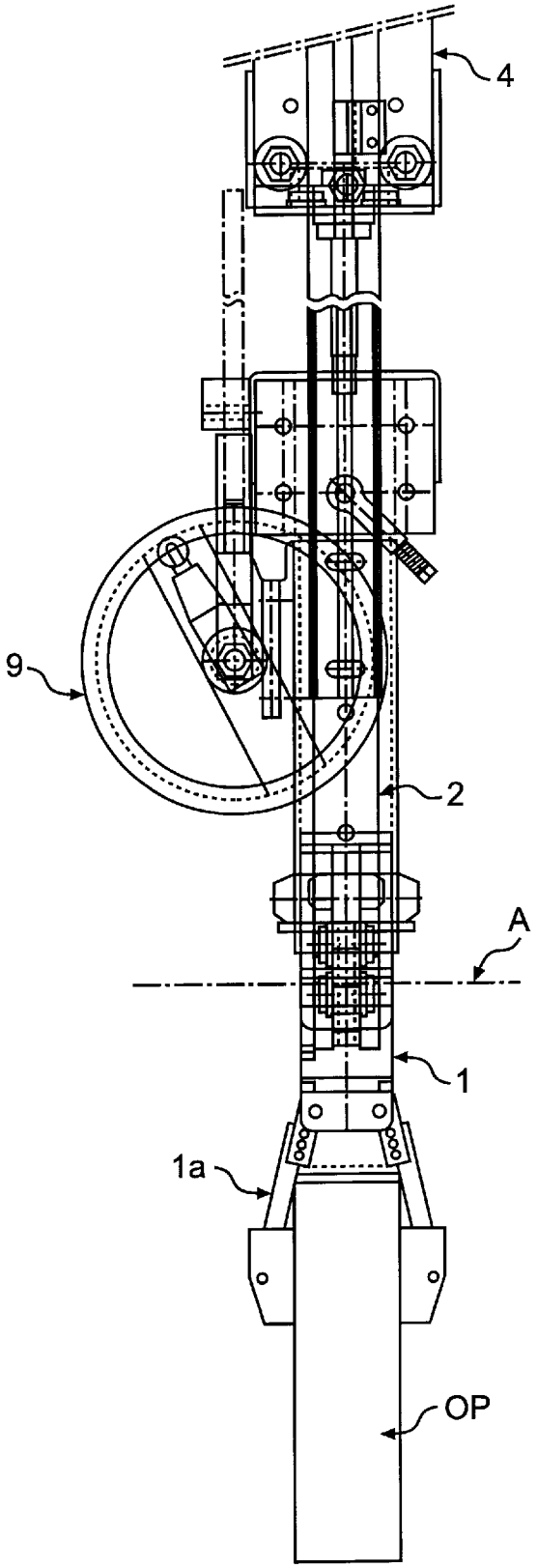
FIG. 3 shows the apparatus of the invention from the side.

The apparatus shown in FIGS. 2 and 3 comprises a gripper 1 comprising a pair of fingers 1*a* on both sides of the gripping point. The fingers 1*a* are directed in each pair preferably obliquely away from each other, i.e. they make a V opening in the gripping direction. The gripper is suspended at the lower end of a vertical arm 2 to be rotatable around a horizontal axis perpendicular to the longitudinal direction of the arm. In this rotating part, indicated in the figure with the reference number 3, there is still another rotation axis B arranged perpendicular to the axis A and extending roughly through the gripping space between the pairs of fingers. The arm 2 is arranged to be movable in the vertical direction in a guide 4 (in this case a roller plate, the upper end of the arm being guided between the rollers) which, in turn, is fixed to a horizontal bar 5 fixed to the body of the apparatus. The gripping and rotating device is placed at a suitable height above the level for handling articles, such as a table for handling envelopes.

Axes A and B constitute the rotating axes for effecting suitable turning movements of stack portions held by the gripper 1.

In the starting position, the element 3 has been turned in a receiving position so that the gripper 1, i.e. its fingers 1*a* point towards the longitudinal side of the continuous stack P brought along the handling level and coming e.g. from an apparatus for manufacturing envelopes. The levels of the articles are upright in the stack, i.e. their edges lie against the handling level. Thus the receiving space of the gripper opens in a direction perpendicular to the running direction of the stack. From this stack, a stack portion OP is pushed between the fingers of the gripper 1 by a pusher, known as such, placed on the opposite side of the stack, and the fingers 1*a* are turned towards each other, pressing the stack portion between them. In the stack, the stack portions are marked with marker envelopes M left to protrude outwards to utilize them for separation of the stack portions.

At the tips of the fingers of the gripper, there are grip pieces having a gripping surface of a suitable elastic, non-smearing material, and they are articulated to be freely pivotable in the fingers, to be turned e.g. within a certain range of motion, so that they are automatically placed against both sides of the stack.

In the following, we shall describe a simple operation of moving the stack portion into the product group forming device. Thus, the arm 2 is lifted upwards in the guide 4, wherein the stack portion OP rises in the gripper 1 up from the handling level, and the part 3 is turned 90° around the axis A, and consequently the stack portion OP is simultaneously caused to turn 90° in the direction of the planes of the articles from the original position and is moved in the horizontal direction away from the path of the stack P to the product batch forming device. Thus, the opening space of the gripper faces directly downwards, i.e. the gripper hangs the stack portion downwards. After this, the arm 2 is lowered down so that the stack portion OP can be delivered to the product batch forming device by releasing the grip of the fingers 1*a*. After this, the gripper 1 returns via a reverse path to its original position to receive a new stack portion OP.

When the transfer of the stack portion OP is effected with an additional rotation, the starting position (receiving position of the gripper) and the final position (delivering position of the gripper) are in principle exactly the same, but during the series of motions between these positions, the stack portion OP has been rotated 180° by rotating the gripper 1 around the axis B. This is conducted preferably at the stage when the stack portion OP is lifted up before the 90° turn to the product batch forming device. Thus, single articles in the stack portion OP are rotated 180° around an axis extending in the direction of their planes, wherein the thicker parts at their ends point to the opposite direction than in the original position.

It is obvious that by alternating the two different series of motions in a suitable way, in the product batch to be formed in the forming device stack portions OP are obtained wherein the thicker ends of the articles point to opposite directions. For example, stack portions OP can be transferred to the product batch forming device alternately with a simple 90° turn and a 90° turn containing a 180° rotation, wherein every other stack portion points to the same direction. The gripper can also be programmed to conduct the differing transfer movements in another order. Further, the 90° rotational motion around the axis extending perpendicularly to the planes of the articles is not necessarily needed, if it is not necessary to change the position of the articles in this direction. In the receiving position, the gripper can also grip the stack portion from above, and the transfer can be effected e.g. as a linear movement to the product batch forming device, naturally by conducting the required number of rotations of the stack portions the other way round.

The turning radius of the gripper 1 around the axis A at the lower end of the arm 2 can be arranged so that the stack portions OP come automatically to the product batch forming device. Thus, the guide 4 does not need to be moved in horizontal direction, but it can be arranged movable in the horizontal bar 5 to a desired position for arranging the transfer paths according to the sizes of the articles. Also, the reciprocating vertical travel length, as well as initial height of the arm 2, can be adjustable according to the same criteria. The initial height can be adjusted e.g. manually by changing the length of the arm 2 with a hand wheel 9 provided in the lower part of the arm 2, as shown in FIGS. 2 and 3, for rotating a screw rod which is in engagement with the screw thread in the upper part of the arm.

Figure 4:
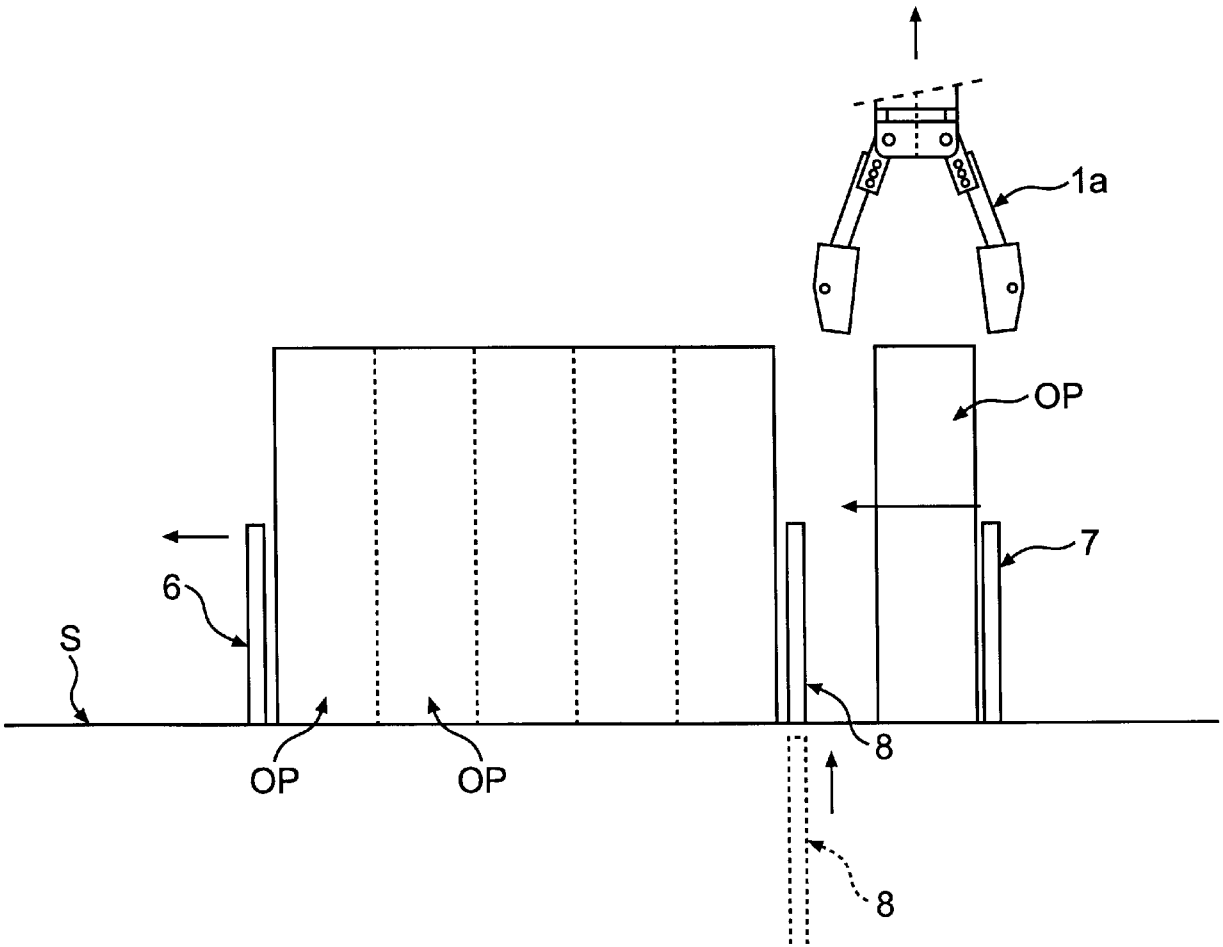
FIG. 4 shows the operating principle of the product batch forming device.

In the forming device shown in FIG. 4, the product batch to be placed in the package is formed of stack portions OP by arranging the stack portions OP, which were obtained in the above-mentioned way by rotating them in different directions, adjacent to each other so that a product batch with a suitable length is formed in a direction approximately transverse to the direction of the turning motion of the gripper 1. The stack portions brought by the gripper can be arranged next to each other in several ways, of which one advantageous way will be described in the following. The gripper 1 brings down the stack portion OP upright onto the support base of the forming device, i.e. on the forming level S of the product batch, between a transfer guard 7 and a front guard 6. The front guard 6 is arranged to be movable in the direction of formation of the product batch and to support the continuously growing product batch in the front, whereas the transfer guard 7 is arranged to perform a short transfer motion. After the stack portion OP is released from the grip of the gripper 1 and the gripper 1 is lifted up, the transfer guard 7 removes the stack portion from this area, to which a new stack portion OP is brought by the gripper 1. At the same time, the stack pushes the front guard 6 which is placed in front of it and which can be arranged to be movable with a suitable frictional load. When the transfer guard 7 returns to the other side of the receiving area, a holding guard 8 rises simultaneously up from the support level to support the stack portion OP from the back. The holding guard always descends underneath the support level to clear the way when a new stack portion is pushed against the preceding one by the transfer guard 7, whereafter it will rise again to support the grown stack from the back. In this way, the whole stack or product batch is formed of stack portions. Also the transfer guard 7 can be arranged movable back and forth in the vertical direction so that it can be moved to its initial position while being underneath the support base, wherein the stack portion OP can be brought by the gripper even at this stage, and it will rise up first on the other side of the stack portion. The holding guard 8 can be located by the side of the path of the transfer guide 7 e.g. in a short groove in which the position of the holding guard can be adjusted. All guards can be arranged as vertical rods in pairs, for obtaining sufficient support to the product batch.

When the front guard 6 is in its final position, the product batch is finished in the forming device, and it is pushed from the side with a suitable pusher to the packaging stage, wherein solutions known in the art can be used. Here it is possible to use also a second gripper, the product batch being pushed between the jaws of the gripper, and the gripper causes the product batch to slide into the package in a way known from the Finnish published specification No. 97355 by the same applicant. After this, the front guard 6 returns to its initial position close to the transfer guide 7.

With respect to the placement of the different parts of the apparatus, the paths of the articles are arranged so that, seen from above, the continuous stack P is brought in one direction by a conveyor, the transfer path of the gripper is perpendicular to this incoming direction, and product batch formation (direction of motion of the front guard 6) is continued from the delivery point of the gripper 1 in the same direction as the incoming direction of the stack P. The handling of articles according to this is illustrated also in FIG. 1.

Figure 5:
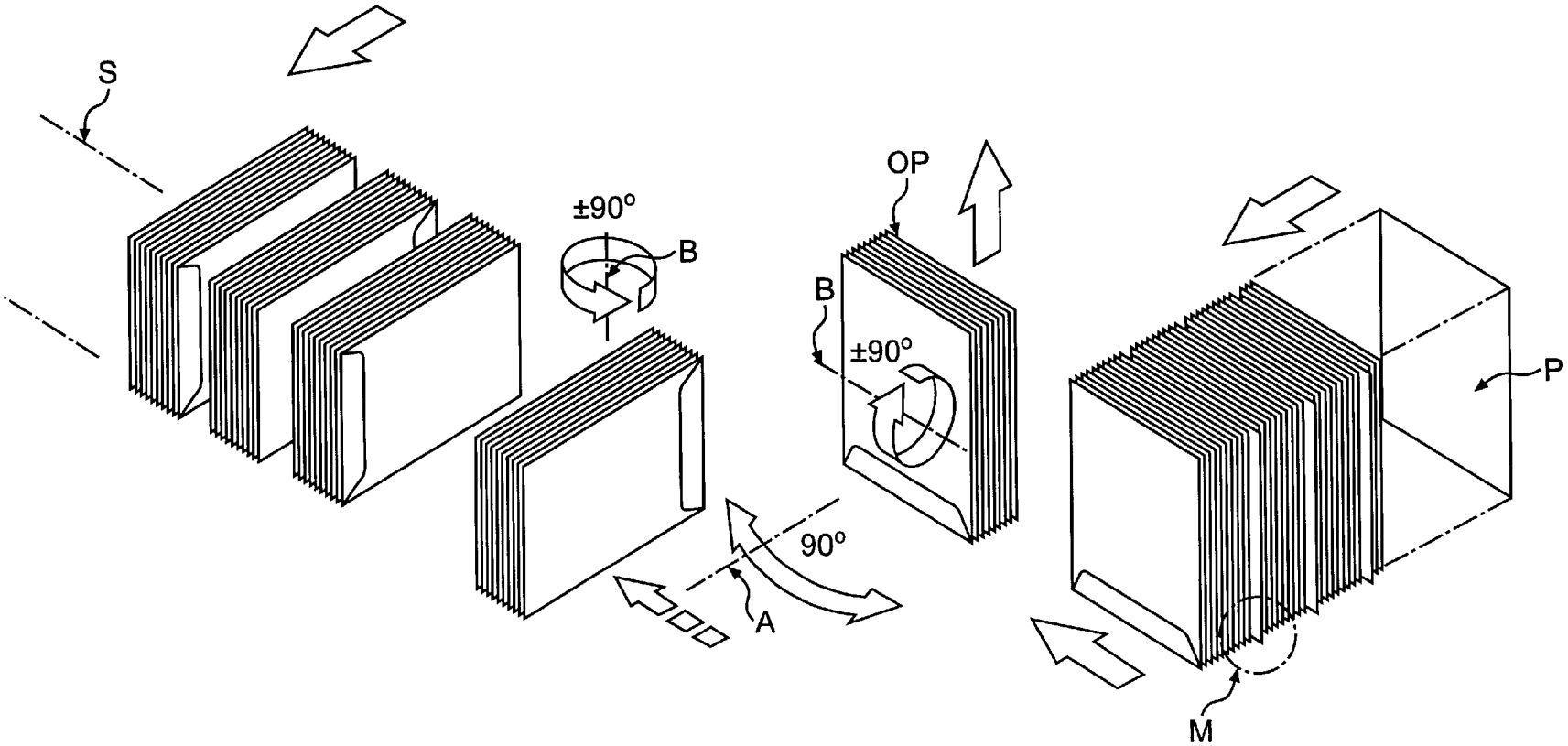
FIG. 5 shows an alternative way of handling of the articles to FIG. 1.

FIG. 5 shows an alternative way of product batch formation. The final structure of the product batch on the forming level S is in other respects the same as above, and its formation can be implemented by using the formation device of FIG. 4. The difference is that after gripping the stack portion OP, each stack portion is also rotated around the axis B, either 90° clockwise or 90° counterclockwise, wherein the 180° directional difference can also be obtained for the thickest ends of the stack portions OP. Thus, due to the extent of the rotating motion, the product batch, however, starts to form in a direction perpendicular to the incoming direction of the stack P. This can be useful, if such a solution is required by the placement of different handling devices in the packaging line. It is also possible that the rotating movements around the axis B have different absolute values so that the sum of the directional deviations is 180°. For example, if the first stack portion OP is rotated 45° in one direction and the second stack portion 135° in another direction, their lower edges come to an inclined position compared with the horizontal plane, due to the rotational movement around the axis A. Thus, the product batch forming level S can be inclined in a corresponding manner.

Figure 1:
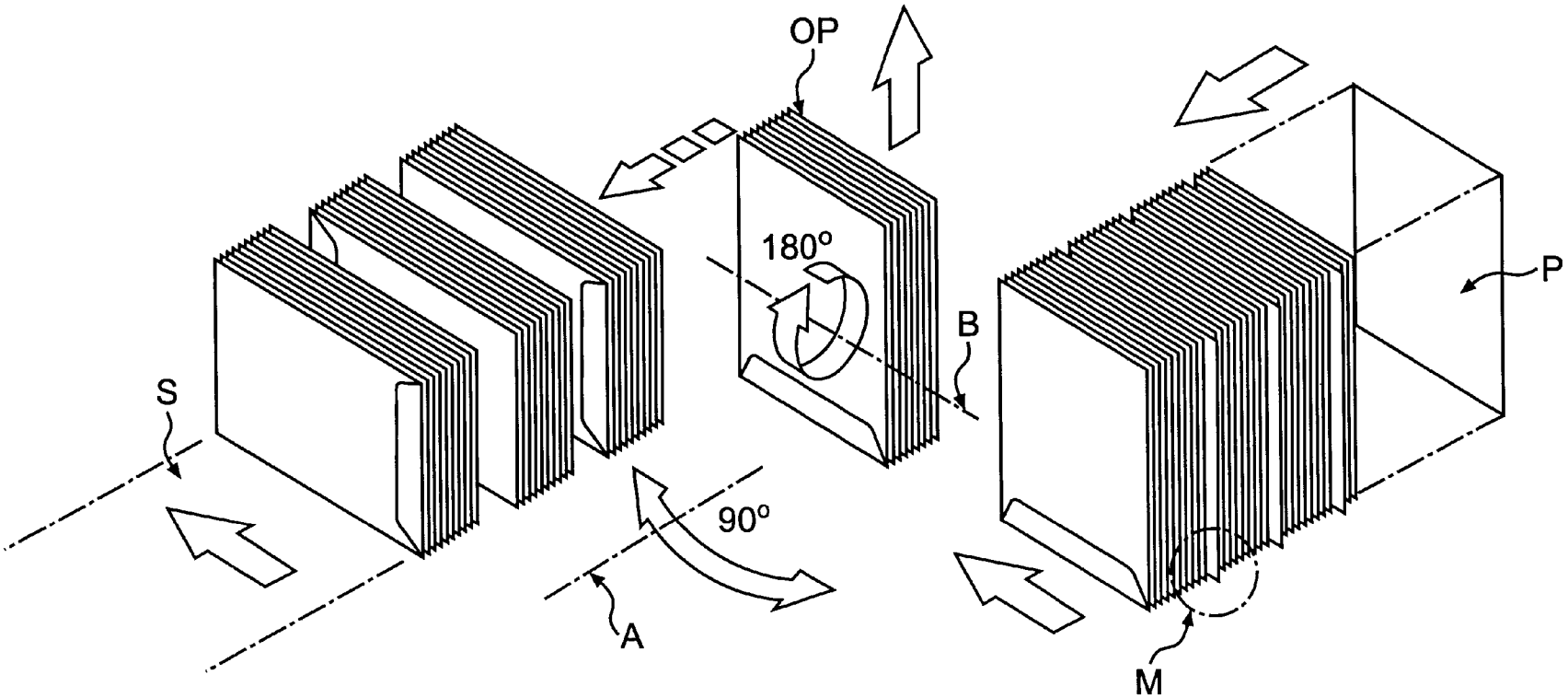
FIG. 1 illustrates the handling of articles.

Naturally in the case of FIGS. 1 and 5, the rotational movement achieving the 180° difference can also be exerted after the rotational movement around the axis A or after some other corresponding transfer movement away from the stack P in the direction of the handling level. This is illustrated also in FIG. 5 (axis B in vertical position).

The invention, particularly the design and suspension of the parts of the transfer device, has several modifications. The actuators and automation are known as such, and the different linear and rotational movements are made by pneumatic actuators or electric motors. The invention is not limited solely to the structural solutions and movement paths presented above, but it can be modified within the scope of the inventive idea presented in the appended claims.

What is claimed is:

1. A method for packaging flat articles, the articles having planes and different thicknesses at different ends in the direction of their planes, the method comprising:

moving the articles in a continuous stack along a support level, the planes of the articles being upright from the support level, to a grouping station;

separating a first stack portion including several articles from the continuous stack;

gripping the first stack potion with a gripping device having two jaws;

rotating the first stack portion, while being held by the gripping device, by movement of the gripping device around a rotation axis so its direction deviates less than 180° from its original direction;

placing the rotated first stack portion next to a second stack portion whose plane is also upright and whose direction relative to the rotation axis deviates 180° from the direction of the first stack portion and less than 180° from the original direction, the first and second stack portions placed next to each other forming a product batch to be placed in a package; and transferring the first and second stack portions with the gripping device away from the continuous stack in upright positions next to each other on a product batch forming level.

2. The method according to claim 1, wherein the first stack portions are rotated around the rotation axis so that their directions deviate 180° from their original directions and the second stack portions are left unrotated around the same rotation axis.

3. The method according to claim 1, the first stack portion is rotated around an axis extending parallel to the planes of the articles in order to achieve a mutual directional deviation of the first and second stack portions.

4. The method according to claim 3, wherein the first stack portion is lifted with a gripping device, after which it is brought to a second position by rotating it both around the axis extending parallel to the planes of the articles and around an axis extending perpendicularly to the axis parallel to the plane, and wherein it is brought down in the second position onto a product batch forming level.

5. The method according to claim 1, wherein the first stack portions and the second stack portions are rotated 90 degrees.

* * * * *